US005423196A

United States Patent [19]

Pollack

[11] Patent Number: 5,423,196

[45] Date of Patent: Jun. 13, 1995

[54] METHOD OF MOUNTING GEMS FLUSH TO ONE ANOTHER IN AN ARTICLE OF JEWELRY, AND ARTICLES OF JEWELRY PRODUCED BY SUCH METHOD

[76] Inventor: Johan Pollack, 24006 Hartland St., West Hills, Calif. 91307

[21] Appl. No.: 227,628

[22] Filed: Apr. 14, 1994

[51] Int. Cl.[6] ..... A44C 17/02

[52] U.S. Cl. ..... 63/28

[58] Field of Search ..... 63/29.1, 28; 29/10

[56] References Cited

U.S. PATENT DOCUMENTS

| | | | |
|---|---|---|---|
| 3,529,373 | 9/1970 | Aaskov | 6/29.1 |
| 5,123,265 | 6/1992 | Ramot | 63/28 |

FOREIGN PATENT DOCUMENTS

| | | | |
|---|---|---|---|
| 44254 | 1/1982 | European Pat. Off. | 63/28 |
| 557624 | 8/1923 | France | 63/28 |
| 826559 | 4/1938 | France | 63/28 |
| 48920 | 9/1938 | France | 63/28 |
| 835817 | 1/1939 | France | 63/28 |
| 513052 | 12/1937 | United Kingdom | 63/28 |

*Primary Examiner*—Michael J. Milano

*Attorney, Agent, or Firm*—Ashen Golant & Lippman

[57] ABSTRACT

A method for mounting two or more side-by-side rows of gems in a article of jewelry so that the gems are flush to one another without spaces or mounting material being visible, and articles of jewelry produced by that method. The gems are mounted along two or more elongated adjacent channels. Direct access into the channels from the top is restricted by inwardly projecting ribs that extend along the sides of the channels for locking the mounted gems in place. Hard stones such as diamonds can simply be forced past the locking ribs. Softer gems such as Zirconium cannot withstand such forces. In the present process, one or more sections of the mounting structure are removed to provide a loading cavity aligned with each of the channels. Gems may be inserted one at a time into a cavity and can then be slid into the exposed end of the associated channel, with matting locking portions of the gem disposed beneath the locking ribs of the channel. When the predetermined gems are slid into place, the removed sections carrying associated gems are replaced to complete the rows of flush gems.

18 Claims, 5 Drawing Sheets

METHOD OF MOUNTING GEMS FLUSH TO ONE ANOTHER IN AN ARTICLE OF JEWELRY, AND ARTICLES OF JEWELRY PRODUCED BY SUCH METHOD

FIELD OF INVENTION

Mounting of multiple gems in an article of jewelry, particularly with gems flush to one another and with no space or mounting material visible.

BACKGROUND OF THE INVENTION

Articles of jewelry in which multiple gems are mounted flush to one another without spaces or material being visible, are very attractive and highly desirable. For example, the gems may be set in two or more adjacent parallel rows that extend around an endless band to form a ring.

Heretofore hard stones such as diamonds have been set in this manner. In accordance with one prior art method, the diamonds are cut with grooves along their sides that engage locking ribs that extend along mounting channels in the mounting structure. The diamonds are forced under high pressure into the channels, the ribs elastically flexing out of the way enough to allow enlarged locking portions of the diamonds that are immediately above the grooves to move past the ribs so that the ribs can seat into the grooves. In this way, the diamonds are locked in place in the channels of the mounting structure.

In accordance with another method, as disclosed in U S. Pat. No. 5,072,601, the diamond is cut with a sawtooth at each side adjacent to its top, and the diamond is then forced downwardly under high pressure into the channel of the mounting structure so as to lock the diamond in place.

The diamonds are hard enough to withstand the forces exerted on them by methods of mounting such as those described above. Softer gems such as zirconium, emeralds, jade and the like are not able to withstand such forces (Diamonds have a hardness rating of about 10, ruby about 9, jade and cubic zirconium about 8 and emerald about 7. For purposes of this application, ratings of below 9 are considered softer). Efforts to mount such softer gems this way produce very high breakage rates. According, such methods as described above are not economical or practical for such softer gems.

SUMMARY OF DISCLOSURE

A method for mounting two or more side-by-side rows of gems in an article of jewelry so that the gems are flush to one another without spaces or mounting material being visible. FIGS. 2 through 5 illustrate the method as applied to a ring 10 having three rows of square cut gems 12 supported on a generally cylindrical mounting structure 14. The mounting structure 14 provides three elongated generally parallel annular channels 22 for each receiving one of the rows of gems. Each illustrated channel 22 has a pair of opposed locking ribs 30 extending along either side of the channel. The gems are formed with matting locking grooves 32 extending along either side of the gem. The channels 22 are open at the top, but the locking ribs 30 restrict the opening so that the gems cannot be directly inserted down into the channels without the application of very large forces. Only extremely hard gems such as diamonds can withstand such forces.

The illustrated mounting structure 14 includes two end walls 16 and two upright intermediate walls 28. These walls 16, 28 carry the locking ribs 30. In accordance with the method, lengths or sections 34 of the intermediate walls 28 are removed to provide, adjacent to each channel 22, a loading area 36. The gems 12 may be inserted into the loading areas 36, and from there slid into the channels 22, with the opposed channel locking ribs 30 received in the matting gem locking grooves 32, respectively. When the desired number of gems have been inserted into the channels, the sections 34 with gems associated with them are replaced to thereby complete the rows of gems. The sections 34 may then be permanently fixed in place. This method is particularly desirable for softer stones such as zirconium which cannot withstand the large forces required for flush mounting in accordance with prior art methods used for diamonds and like hard stones.

IN THE DRAWINGS

DETAILED DESCRIPTION OF DRAWINGS THE PRIOR ART

Figure 1:
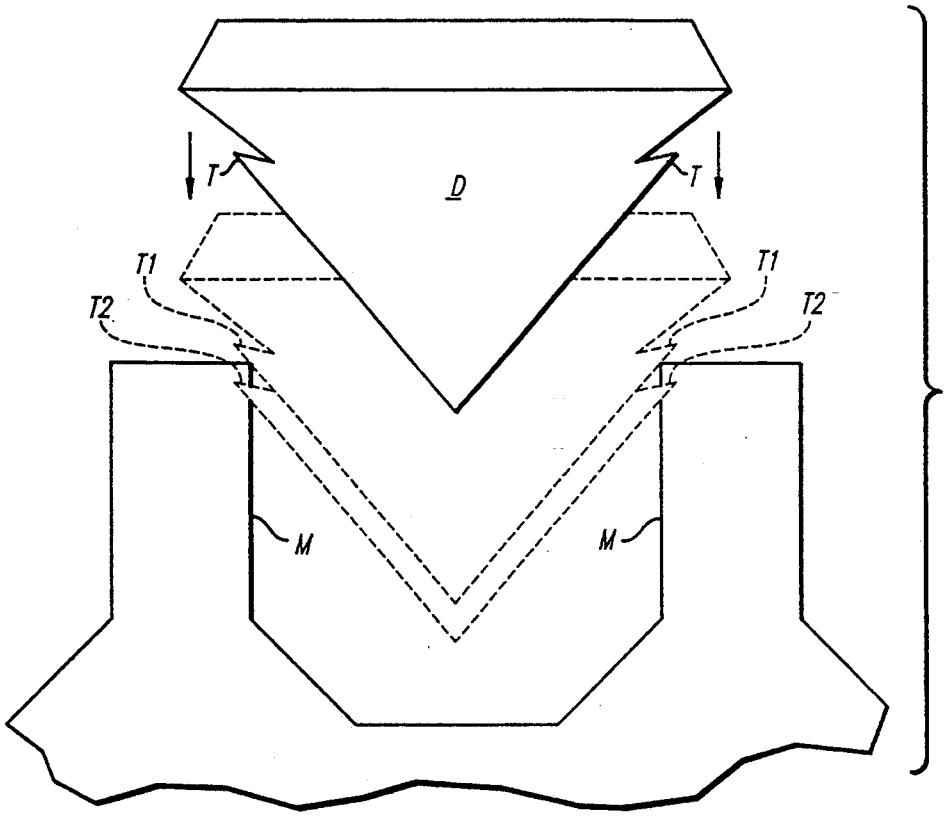
FIG. 1 PRIOR ART
FIG. 1 (PRIOR ART) is a schematic sectional view of a diamond being set in accordance with a prior art method.

FIG. 1 illustrates a prior art method of mounting side-by-side rows of hard gems such as diamonds in a article of jewelry. The diamonds are flush with one another with no space or mounting material being visible between adjacent stones. This method is described in detail in U.S. Pat. No. 5,072,601 referred to above. As shown in solid line in FIG. 1, the diamond D is cut with a pair of parallel side sawteeth T for locking the diamond in the mounting or setting. The mounting is provided with two or more elongated adjacent parallel channels, for each for receiving and holding a row of the diamonds. The illustrated diamonds are each cut in the shape known as a "square cut" which means that as viewed from the top, the diamond is generally square. The lower portion of each diamond has its side walls angle inwardly downwardly to meet each other and form a generally triangular configuration as viewed in transverse section. The locking sawteeth T noted above extend longitudinally along the side walls, with one sawtooth at each side of the diamond intermediate its top and bottom. It is desirable that these teeth T be as close as possible to the square upper portion of the diamond to provide the maximum support and locking of the diamond in the setting.

FIG. 1 also illustrates in broken line the diamond being forced into place in the setting by heavy downward pressure (represented by the arrow). The sawtooth is shown at T1 just engaging and extending beyond the mounting wall M. The sawtooth is then shown at T2 having been forced down and biting into the wall M. The setting material of wall M is somewhat resilient and giving to allow the diamond to be forced to that position. A great deal of force is exerted however on the diamond, particularly at a vulnerable areas around the sawtooth. A diamond has the hardness and strength characteristic to normally withstand such forces. As noted above, softer stones such as zirconium, jade, emeralds, etc. do not have the requisite strength and therefore cannot practically or economically be mounted in this manner.

THE PRESENTLY PREFERRED METHOD

As note above, the method of the invention affords relatively easy, economical and fast assembly or mounting of softer stones in a flush mounting of this type of jewelry without imposing such high forces on the gems and therefore allowing their production with a minimum breakage rate. Thus, it provides a very practical and economical way to mass produce such multi-row flush mounted gems.

Figure 2:
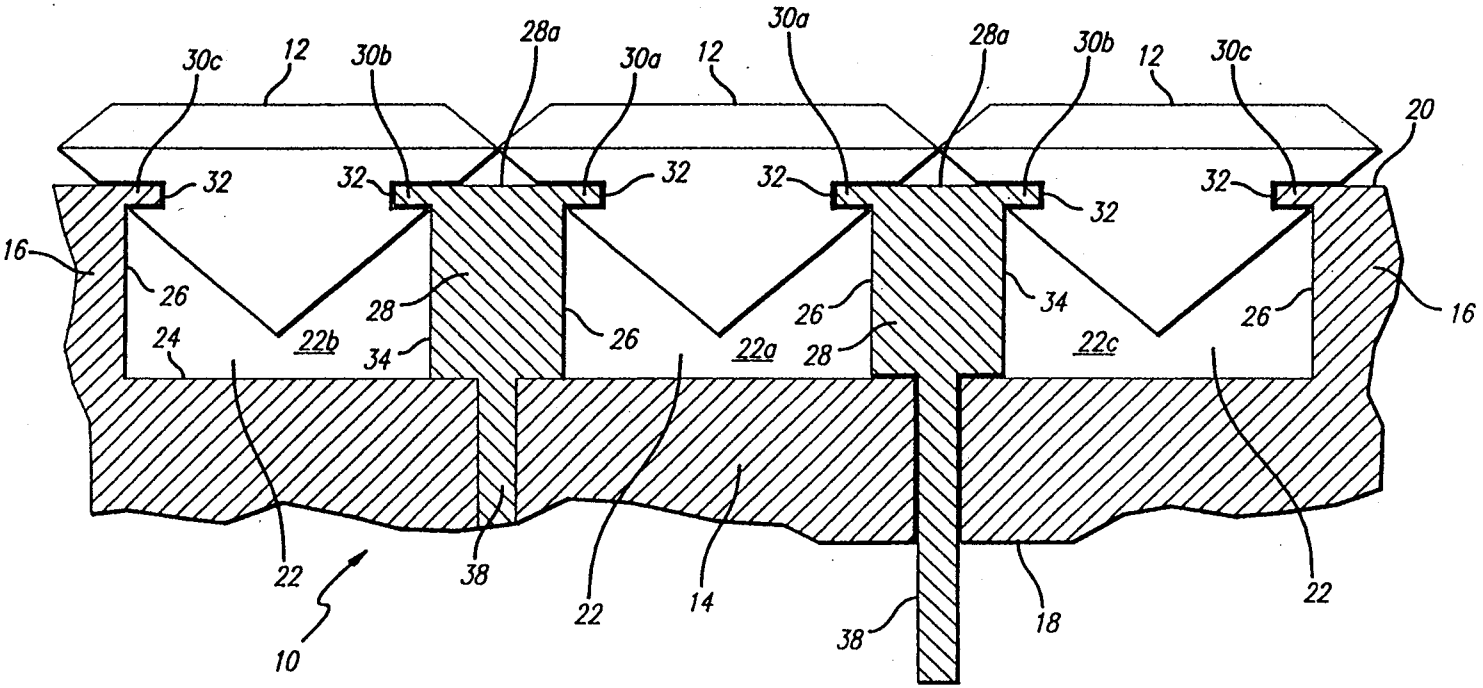
FIG. 2 is an enlarged schematic sectional view of a ring having multi-rows of flush-mounted gems that have been mounted in accordance with the method of the present invention.

FIG. 2 shows, in schematic cross-section, a ring 10 produced by the method of the present invention. The ring 10 has three rows of square cut gems 12 mounted flush to each other and without spaces or mounting material showing between adjacent gems. This method is useful and desirable for mounting all gems in such an arrangement, but is particularly advantageous for use with softer gems such as zirconium which could not practically or economically be produced in such configuration by prior art methods.

Figure 3:
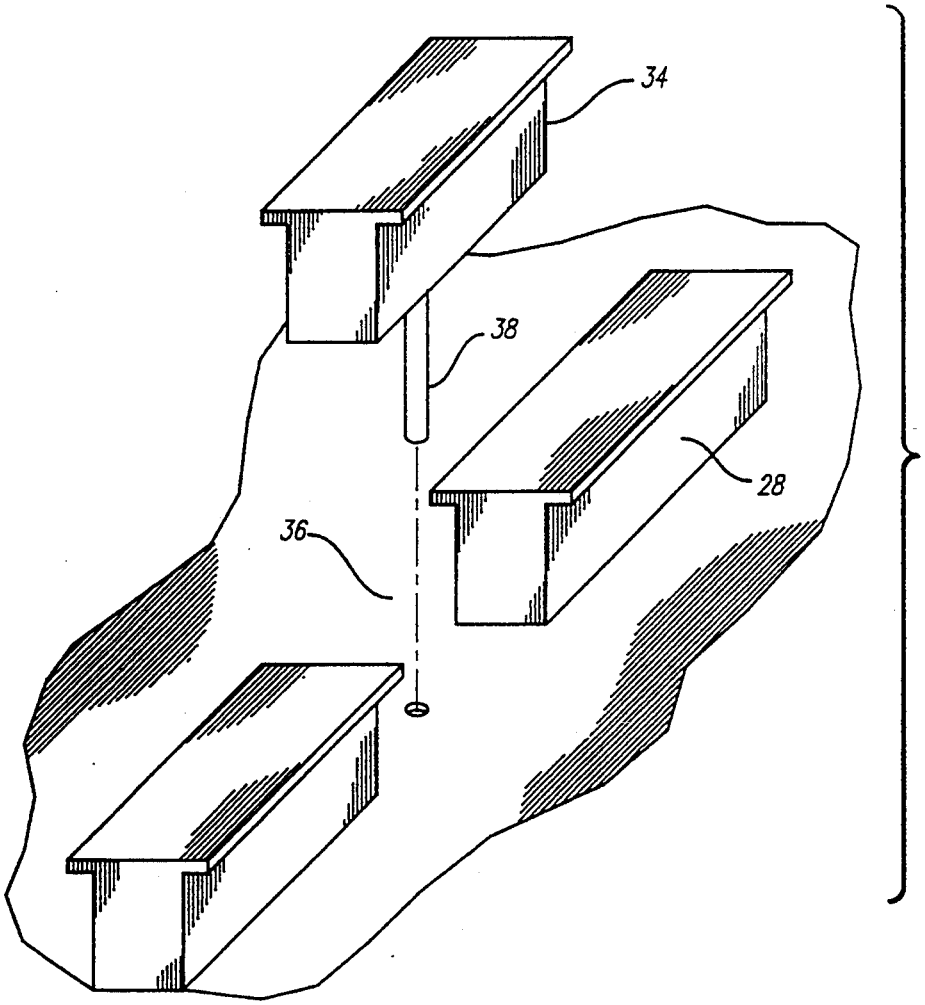
FIG. 3 is a schematic perspective showing a intermediate step in mounting of that method.
Figure 4:
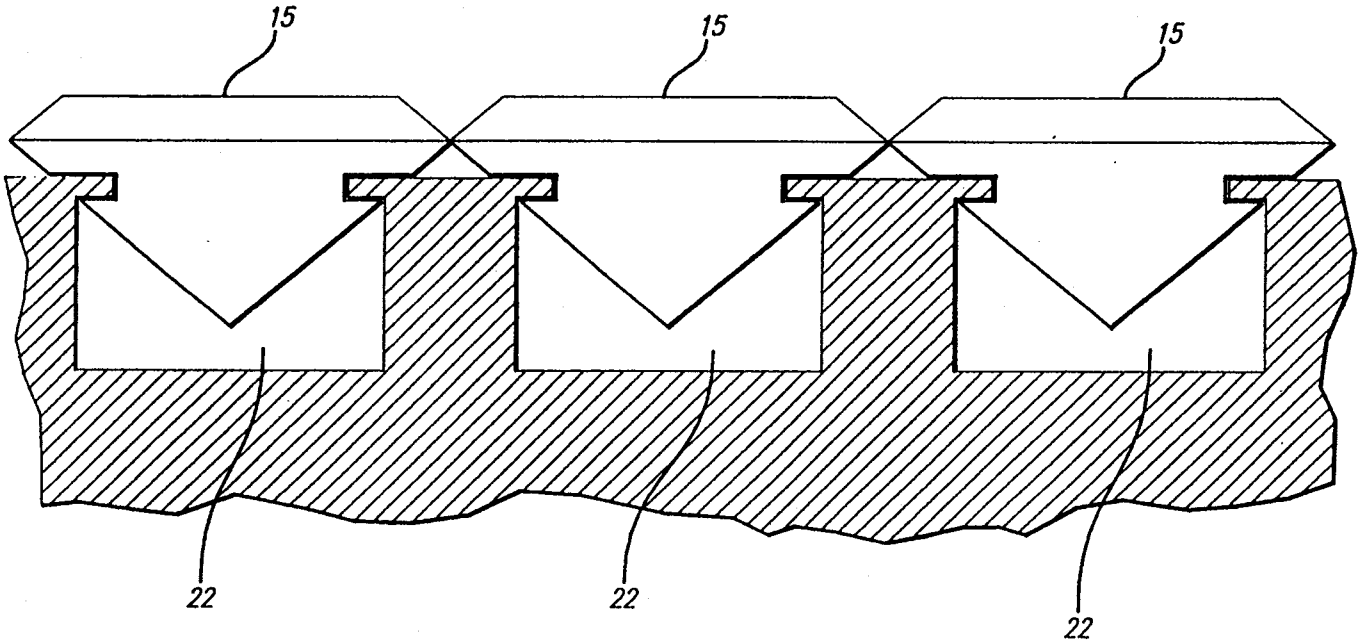
FIGS. 4 and 5 are schematic sectional views illustrating additional intermediate steps of that method.
Figure 5:
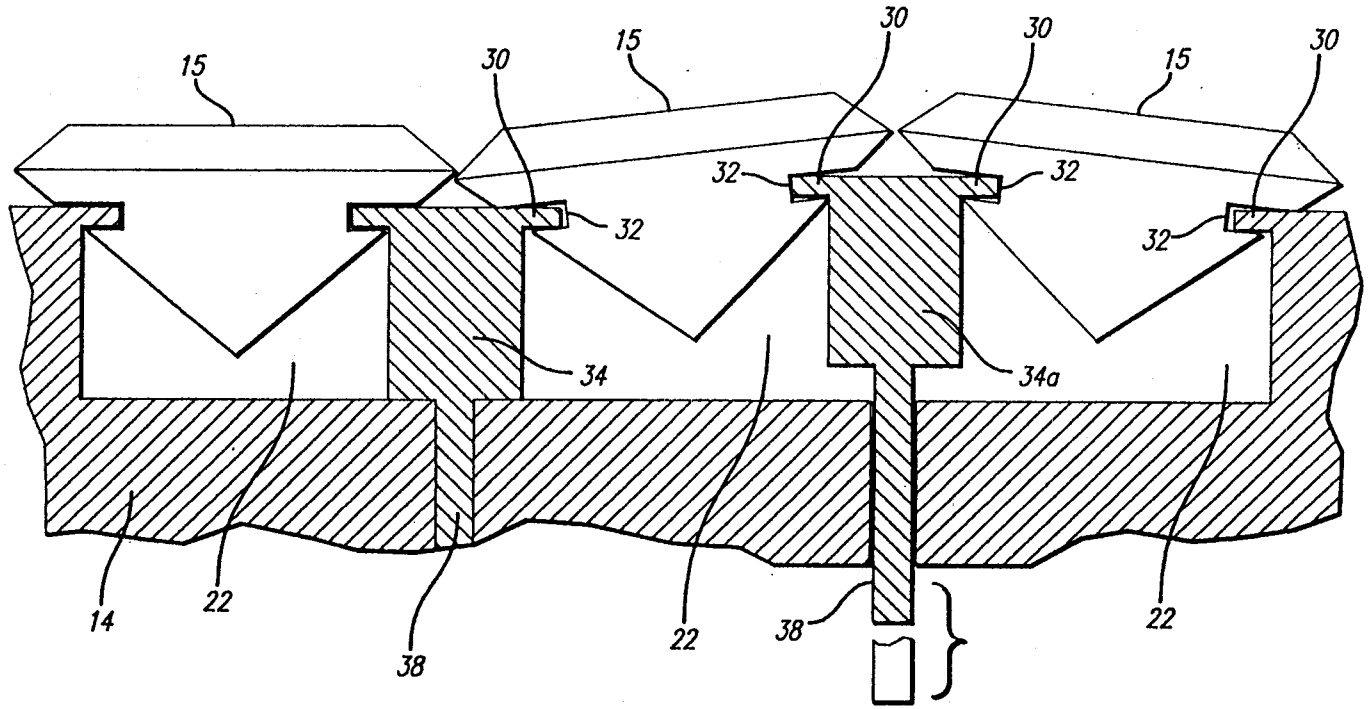

FIGS. 3, 4 and 5 schematically illustrate several steps of the new and improved method which embodies the presently preferred form of the mounting process of the present invention.

The mounting structure 14 for a ring 10 is generally in the shape of a small cylinder (not shown) sized to fit on a person's finger. As shown schematically and fragmentally in FIG. 2, the cylinder has a pair of end walls 16, a cylindrical inner surface 18 and generally cylindrical outer surface 20. A plurality of spaced-apart circumferential channels 22 are formed in the outer surface of the cylinder, and they extend completely around the cylinder to form endless loops. The illustrated channels 22 are each generally rectangular in transverse cross-section. The illustrated mounting structure has three of the channels, an inner or central channel **22*a* and two outer or side channels 22*b*, 22*c***.

Each of the channels 22 has a bottom or radially inward or bottom surface 24 and a pair of side surfaces 26. As shown in FIG. 2, the side surfaces 26 of the central channel **22*a* are defined by a pair of upright intermediate wall 28. The upper end 28*a* of each wall 28 extends outwardly in either direction to provide a generally T-shape transverse cross-section. The extension portions that extend into the center channel 22*a* provide the locking and holding ribs 30*a* for that channel. The extension portions of the two intermediate walls that extend outwardly to the side respectively into the two side channels 22*b* and 22*c*, provide a locking and holding rib 30*b* for each of those channels. The locking rib 30*c* for the outer most side of each of the side channels 22*b*, 22*c* is provided by an inward extension of one of the upright end walls 16**.

FIG. 2 shows how the longitudinal channels 22 receive and hold the fully mounted gems 12 in place. Each of the channels 22 is provided with an opposed inwardly directed pair of the locking ribs 30. The ribs 30 each seat within a matting longitudinal locking groove 32 along the adjacent side of the associated gems.

Thus, as shown in that FIG. 2, the bottom surface of each of the rectangular grooves 32 of each of the gems engages or is immediately adjacent below the downwardly facing undersurface of the matting locking rib 30, to thereby retain that side of the gem in place.

The channels 22 are thus each provided at either side with an inwardly extending locking rib 30 and the gems in those channels each have a pair of opposed longitudinal locking grooves 32 to mate with those ribs.

In accordance with the illustrated method, to provide rapid and ready access to the channels 22, one or more removable sections 34 of the mounting structure are provided. FIG. 3 schematically shows a section 34 as a length of an intermediate upright wall 28. As shown in FIG. 2, for a three row ring 10, there is removable section 34 for each of the two intermediate upright walls 28. The removal of a section 34 provides a loading cavity 36 wherein gems 12 can be placed in longitudinal alignment with adjacent channels 22. The side grooves 32 of a gem can be aligned with the ribs 30 of the receiving channel, and the gem can then be slid along into that channel. This obviates having to force the gems into the channels from above as in the prior art.

FIG. 4 shows three of the gems 12 having been slid into place in their respective channels. The gems are generally flush to one another side-to-side.

After the desired number of gems have been inserted into the channels, the removed sections 34, carrying their associated gems, are inserted back into place to complete the rows. FIG. 5 schematically shows one section **34*a* being lowered into place. The gems on either side are tilted so that the grooves 32 can receive the ribs 30 of the associated channels 22. The height of the grooves is greater than the height of the matting ribs to accommodate this tilting. Then the section 34*a* is lowered into place, which brings the gems to the level positions shown in FIG. 2. As shown in FIGS. 2 and 5, each section 34 has a stem 38 that extends through a matting hole in the mounting structure 14. As shown in FIGS. 2 and 5, the stem 38 is originally much longer than the matting hole so that the end of the stem protrudes into the open center area of the ring. This allows the stem end to be pulled downwardly to assist in replacing the section 34 and properly setting the gems. Once a section 34 is fully repositioned (FIG. 2**) it may be soldered in place, the end ground or filed off, and the surface polished. If it is later necessary to replace or repair gems, the stem can simply be drilled out.

In this way, the complete endless loops or rows of gems are provided in side-by-side rows, with adjacent gems flush to one another and with no space or mounting materials showing between adjacent gems. Because the gems are simply slid into position from the aligned loading cavity into the channels, no large forces are exerted on the gems as might break or crack them. The completed ring does not show any lines or breaks around its circumference that would detract from its appearance.

A good pace for setting diamonds in flush arrangements by prior art methods is about 8 stones an hour. By using the present method, gems can be set at rates in the area of 200/hour by an experienced worker.

Various modifications and changes may be made to the illustrated form of the invention without departing from the spirit and scope of the invention as set forth in the following claims. For example, there may be two rows, or four or more rows of gems. The rows may be provided on articles of jewelry other than rings, as for example pins, earrings, necklaces, etc. The rows need not be continuously loops but may be shorter segments of either straight or curved rows.

The illustrated method may be used for a wide variety of cut or formed stones or gems ranging in hardness from ratings about 10 down to about 4. As noted above, it has particular utility for gems that are relatively softer (i.e., below a rating of about 9) and which therefore cannot withstand the forces applied using the prior art mounting techniques.

I claim:

1. A method for setting a plurality of gems in an article of jewelry so that the gems are aligned in at least two adjacent rows with the gems being generally flush to one another and with generally no space or setting material visible between them, the steps of:

1) providing a mounting structure with at least two elongated adjacent, generally parallel channels for each receiving therein a series of the gems arranged in-line longitudinally of the channel, each channel having locking means therein that extend therealong and inwardly for engaging matting locking portions of the mounted gems to lock such gems in place in the channel, each channel being open at the top but said locking means blocking direct entry of the gems into the channels from above;
2) removing portions of the mounting structure so as to provide for each channel a loading cavity aligned with the channel that is at least as long, measured longitudinally of the channel, as the length of the largest of the gems, measured longitudinally of the channel, to be mounted in that channel;
3) inserting a gem into the loading cavity and then sliding the gem longitudinally along a channel so that said locking means on the channel overlys said locking portions on the gem and thereby locks the gem in the channel and prevents it exiting through the open top of the channel;
4) inserting additional gems into the channels in the manner provided in Step 3, to provide the desired number of gems in each channel aside from the portions of the channels spanned by the removed portions; and
5) replacing the removed portions along with all gems associated with such portions.

2. The method of claim 1 wherein the channels are formed in part by at least one intermediate upright wall, the removing step involving removing a length of each such intermediate wall.

3. The method of claim 2 wherein the removable length has an extension that passes downwardly through a matting opening in the mounting structure, the added step of pulling downwardly on the extension to facilitate replacement of the length in the mounting structure.

4. The method of claim 3 further including the step of permanently fixing the length in place in the mounting structure.

5. The method of claim 4 wherein the permanent fixing is by soldering the extension to the mounting structure.

6. The method of claim 5 further including the step of grinding off the excess portion of the extension and the soldering material.

7. The method of claim 6 further including the step of polishing the ground area.

8. The method of claim 1 wherein the hardness rating of at least one of the gems is under about nine (9).

9. The method of claim 1 wherein the hardness rating of at least one of the gems is in the range from about four (4) to about eight (8).

10. An article of jewelry having a plurality of gems aligned in at least two adjacent rows, with the gems being generally flush to one another and with generally no space or setting material visible between them, the article being produced in accordance with a method comprised of the following steps:

1) providing a mounting structure with at least two elongated adjacent, generally parallel channels for each receiving therein a series of the gems arranged in-line longitudinally of the channel, each channel having locking means therein that extend therealong and inwardly for engaging matting locking portions of the mounted gems to lock such gems in place in the channel, each channel being open at the top but said locking means blocking direct entry of the gems into the channels from above;
2) removing portions of the mounting structure so as to provide for each channel a loading cavity aligned with the channel that is at least as long, measured longitudinally of the channel, as the length of the largest of the gems, measured longitudinally of the channel, to be mounted in that channel;
3) inserting a gem into the loading cavity and then sliding the gem longitudinally along a channel so that said locking means on the channel overlys said locking portions on the gem and thereby locks the gem in the channel and prevents it exiting through the open top of the channel;
4) inserting additional gems into the channels in the manner provided in Step 3, to provide the desired number of gems in each channel aside from the portions of the channels spanned by the removed portions; and
5) replacing the removed portions along with all gems associated with such portions.

11. The article of jewelry of claim 10 wherein said channels are formed in part by at least one intermediate upright wall, the removed portion of the mounting structure being a length of each such intermediate wall.

12. The article of jewelry of claim 11 wherein each intermediate wall is generally T-shaped in cross-section.

13. The article of jewelry of claim 11 wherein the removed length has a downward extension that passes downwardly through a matting opening in the mounting structure sufficiently for the extension to be grasped and pulled downwardly to facilitate replacement of the length in its place in the mounting structure.

14. The article of jewelry of claim 11 wherein the removal length has a downward extension that passes downwardly through a matting opening in the mounting structure, said article further including means permanently fixing the extension to the mounting structure.

15. The article of jewelry of claim 14 wherein said means for permanently fixing is a soldered joint.

16. The article of jewelry of claim 10 wherein the hardness rating of at least one of the gems is less than about nine (9).

17. The article of jewelry of claim 10 wherein the hardness rating of at least one of the gems is in a range of from about four (4) to about eight (8).

18. The article of jewelry of claim 10 wherein at least one of the gems is made of zirconium.

* * * * *